US005402717A

United States Patent [19]

Benard et al.

[11] Patent Number: 5,402,717

[45] Date of Patent: Apr. 4, 1995

[54] DEVICE FOR SETTING PRINTWHEELS IN A POSTAGE METER

[75] Inventors: Serge Benard, Bois-Colombes; Michel Gravillon, Sucy en Brie, both of France

[73] Assignee: Neopost Industrie, Bagneux, France

[21] Appl. No.: 171,665

[22] Filed: Dec. 22, 1993

[30] Foreign Application Priority Data

Dec. 22, 1992 [FR] France ..... 92 15495

[51] Int. Cl.[6] ..... B41J 1/60

[52] U.S. Cl. ..... 101/99; 101/91; 101/110

[58] Field of Search ..... 101/45, 91, 92, 93, 101/93.20, 93.21, 99, 106, 110, 101, 85–89; 235/101

[56] References Cited

U.S. PATENT DOCUMENTS

| | | | |
|---|---|---|---|
| 1,188,828 | 6/1916 | Putnam | 101/110 |
| 4,020,757 | 5/1977 | Christensen | 101/110 X |
| 4,702,164 | 10/1987 | Muller | 101/91 |
| 4,723,486 | 2/1988 | Le Meur et al. | 101/91 |
| 4,774,881 | 10/1988 | Schubert | 101/91 |
| 5,154,118 | 10/1992 | Doery et al. | 101/91 |
| 5,163,366 | 11/1992 | Gregoire et al. | 101/91 |
| 5,170,705 | 12/1992 | Haroutel | 101/91 |
| 5,279,219 | 1/1994 | Hoffa | 101/99 |
| 5,309,830 | 5/1994 | Vermesse | 101/91 |

FOREIGN PATENT DOCUMENTS

| | | | |
|---|---|---|---|
| 0470551A1 | 2/1992 | France . | |
| 0227053 | 10/1986 | Japan | 101/110 |
| 2102346 | 2/1983 | United Kingdom . | |
| WO9016047 | 12/1990 | WIPO . | |

*Primary Examiner*—Edgar S. Burr
*Assistant Examiner*—Christopher A. Bennett
*Attorney, Agent, or Firm*—Sughrue, Mion, Zinn, Macpeak & Seas

[57] ABSTRACT

A device for setting the position of printwheels (5) included in a removable head (2) of a postage meter. A pivotable control module (17) is provided in the base (1), and is mounted on resilient supports (29). It carries motors (M1, M2, M3, M4) mounted in a circular arc around a cylindrical block (16) of driving gear wheels (R3). When the module (17) is pivoted forwards, it meshes with drive systems (20) having gear wheels (19, 21, 22, 23) that enable the printwheels (5) to be rotated.

6 Claims, 8 Drawing Sheets

DEVICE FOR SETTING PRINTWHEELS IN A POSTAGE METER

BACKGROUND OF THE INVENTION

The present invention relates to postage meters (or "franking machines") having a print head that is removably mounted on a base and in which the print head has a print drum that carries printwheels. In such machines the invention relates more particularly to the device for setting the printwheels.

In conventional manner, such printwheels are mounted to rotate relative to the drum so as to enable their positions to be set, providing postage is not actually being printed. These printwheels project slightly from the periphery of the drum and they rotate together with the drum for the purpose of printing both fixed and variable postage information on each revolution of the drum. The printwheels are used for printing variable information concerning the postage amount and the date of franking. The print drum therefore carries two sets of printwheels for such variable information, which wheels project from the drum through appropriate openings in an engraved plate for printing a postage flier. The engaged plate fits around the periphery of the drum and carries fixed postage information in the form of a postage "stamp", a mention of the home post office, or another information. The same drum generally also carries an additional "advertising" engraved plate that is analogous to the first but that is generally removably mounted and that is used for printing fixed advertising information. In some machines, other print means such as one or more removable blocks are associated with the drum.

Document FR-A-2 335 002 describes a franking machine of the above-specified type having a device for setting the value printwheels with each printwheel being under manual control. That device comprises appropriate transmission means that are identical and that are disposed between each printwheel and its control means, the transmission means being constituted by driving gear wheels coupled to one another and to manual control means, and one or more driven gear wheels that are coupled to one another and to the corresponding printwheel, together with two racks that are coupled to each other and to one of the driven gear wheels and to one of the driving gear wheels.

Other postage meters no longer use manual control for setting the positions of the printwheels, but instead they use automatic control. Such automatic control is performed from a keypad of the machine and by means of logic control circuits connected to a drive motor and to one of the driving gear wheels as mentioned above.

In a postage meter having a removable head, the device for controlling the position settings of the various printwheels is mounted together with motors for performing this function and located within the print head. This makes the print head relatively bulky and heavy, thus making it more difficult to transport. In addition, a removable print head is a security module into which access by the user or by any other person not authorized by the postal authority is forbidden. Consequently, an authorized person is required whenever a maintenance problem arises relating specifically to the device for setting the printwheels, which device is complex and has a large number of parts.

In order to avoid such drawbacks, there has already been proposed, in document FR-A-2 665 782 (corresponding to U.S. Pat. No. 5,163,366, a device for setting the printwheels in the head of a postage meter, in which the head is removable relative to a base and includes a print drum fitted with said printwheels and carried on a "front" end of a sleeve whose other or "rear" end projects behind the head, and the base has a front emplacement for the head and includes a drive mechanism and control circuit referred to as a "control card" coupled to the drive mechanism and a rotary spindle coupled to the drive mechanism and projecting in part into the emplacement for the head in order to receive said sleeve thereon and to drive the drum, said device comprising:

- a driving assembly having at least one control motor and at least one driving gear wheel, said assembly being coupled to said control card;
- a plurality of driven gear wheels, each coupled to one of the various printwheels, mounted therewith inside the head; and
- a plurality of sliding rods having "front" and "rear" racks, the rods being mounted in said head with the front rack of each rod engaging on one of the driven gear wheels and transmitting a command thereto as received from the driving assembly.

According to that document FR-A-2 665 782:

- the driving assembly is mounted in the base, in an interface housing immediately behind the front emplacement for the head, and at the periphery of the spindle and of the sleeve engaged on said spindle; and
- the rear racks of the sliding rods project at least in part behind the head and engage the rear end of the sleeve in the base;
- said driving assembly thus being suitable for engaging the rear racks of said rods and constituting a control module in said base for setting the printwheels of the head.

That device still suffers from the drawback of being insufficiently compact and of being insufficiently convenient and flexible for positioning purposes.

The use of racks constitutes a drawback since a rack can be moved back-and-forth only, and cannot be moved continuously. Thus, as a result, if it is desired to display a "0" on a given printwheel after it has been used to print a "9", then it is necessary to cause the associated rack to run along its entire stroke. Overall, the amount of time required for setting is large.

SUMMARY OF THE INVENTION

The invention seeks to remedy those drawbacks. To this end, the invention provides a device for setting the position of printwheels of a head of a postage meter, the head being removable relative to a base and including a print drum fitted with said printwheels, a control module for setting the position of each of the printwheels being provided in the base and including a plurality of externally controlled motors, there being one motor per printwheel whose position is to be set, each of said motors driving at least one respective driving gear wheel likewise provided in said base, and suitable for meshing with a gear drive system that is provided in said head, and acting on a toothed wheel or "driven gear wheel" secured to said printwheel for setting the position thereof, the device being characterized in that:

- said drive system is a rotary gear system constituting a gear train;

said driving gear wheels are coaxial and parallel, together forming a block of substantially cylindrical outline, and said motors are disposed on a circular arc around said block so as to co-operate therewith to form said setting control module;

said control module is mounted to pivot between a rear, retracted position in which said driving gear wheels are disengaged and remote from the respective gear trains included in the head, and a front, extended position in which the same gear wheels are in respective positions where they mesh with the same gear trains; and said control module is mounted on one or more resilient supports connecting it to its pivot axis.

Advantageously, the control module is fitted with at least one centering finger which projects relative to said driving gear wheels towards the head, said centering finger being designed, when the module is pivoted to its meshing front position, to engage in a corresponding orifice of the rotary drum.

Preferably, the same centering finger is also designed, when the module is in its meshing front position and when said finger is thus engaged in said orifice, to act on a device for unlocking the printwheels.

In any event, the invention will be well understood, and its advantages and characteristics will appear more clearly from the following description of a non-limiting embodiment given with reference to the accompanying diagrammatic drawings, in which:

DESCRIPTION OF A PREFERRED EMBODIMENT

Figure 1:
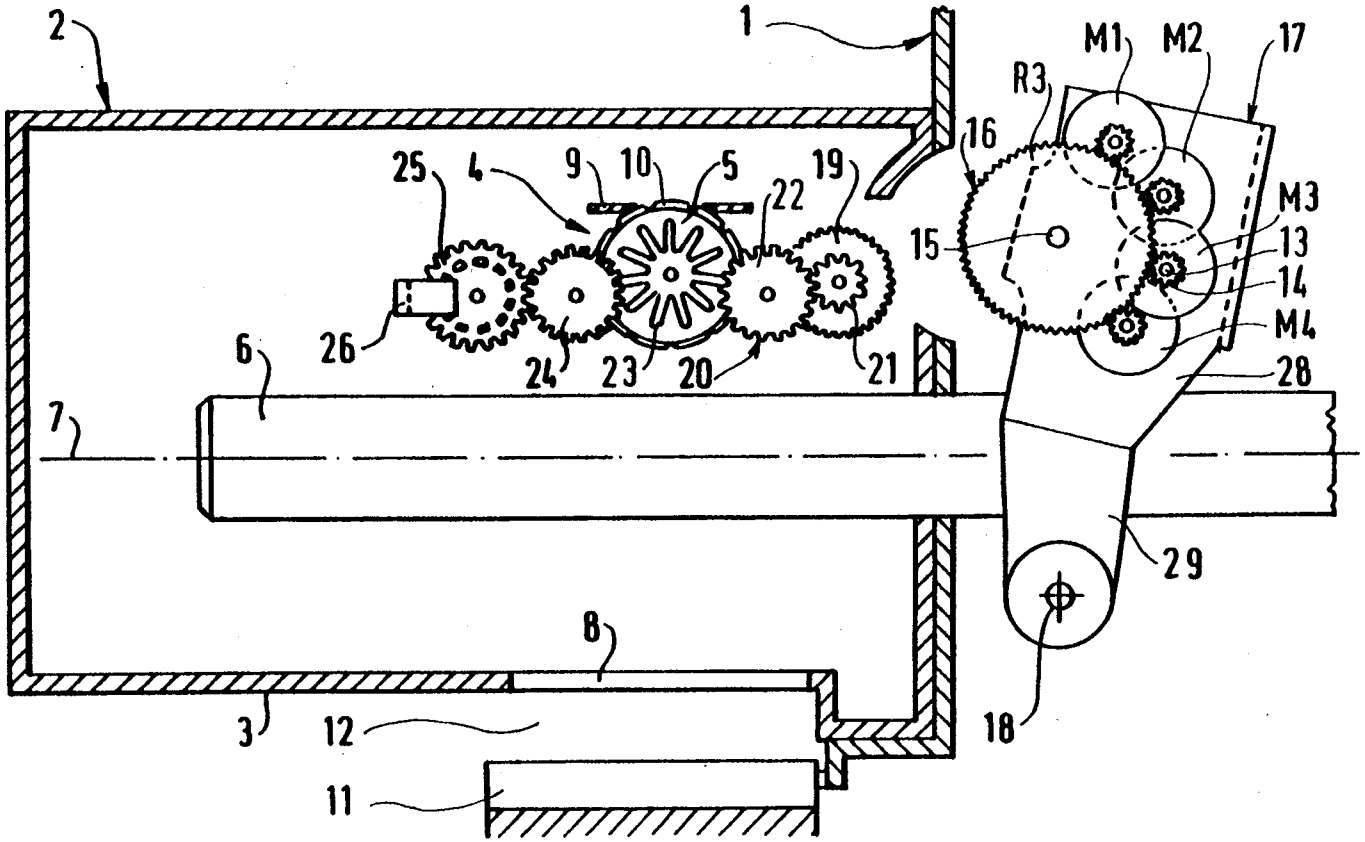
FIG. 1 is a highly simplified longitudinal section through a postage meter of the invention showing a major fraction of the elements of said invention in a furthest-back position inside the base, the module for controlling printwheel setting being in its rear position.

With reference to FIGS. 1 to 4, the postage meter comprises firstly a fixed base 1 and secondly a removable head 2.

The head 2 forms a security module whose various parts are mounted in a substantially sealed housing, the inside of which is not accessible to the user. It contains a rotary print drum 4 which itself carries a plurality of settable printwheels 5 for printing settable values (dates, monetary amounts, . . . ).

In the working position, the head 2 is pressed against the base 1 and it is centered in this position by means of a projecting spindle 6 carried by the base 1. The axis 7 of the spindle coincides with the axis of rotation of the drum 4, and the spindle 6 also serves as a drive member for rotating the drum.

A slot 8 is provided in the bottom face of the head to allow a printing flat 9 carrying the various values to be printed 10 to pass therethrough during rotation of the drum, e.g. the various digits or letters carried by the printwheels 5.

Between the bottom face having the slot 8 and a printing backing roller 11 carried by the base 1, there is a passage 12 in which postage for franking can be inserted.

When the drum 4 is not rotating, it is possible to change the values 10 carried by the printwheels 5 by means of a keypad (not shown) secured to the base 1.

The keypad is connected to a controlling electronics card, which causes a plurality of small electric motors M1, M2, M3, M4, . . . to be driven as a function of the data keyed into the keypad, where each of the motors is associated with setting a respective printwheel. For example, the motor M3 is used for setting the position of the printwheel 5 that is shown in the drawings.

Each motor shaft 13 carries a small gear wheel 14 which rotates a larger driving gear wheel R3. Thus, the base 1 contains as many driving gear wheels R1, R2, R3, R4, . . . as motors M1, M2, M3, M4, . . . , and thus as many driving gear wheels as there are printwheels 5.

All of these driving gear wheels R1, R2, R3, . . . are mounted to rotate about a common shaft 15, and together they form a block 16 of substantially cylindrical outline about the axis 15. In the preferred example shown, these driving gear wheels are all of the same diameter, such that the block 16 has the outline of a right circular cylinder with rectilinear generator lines parallel to the axis 15.

As shown, and according to a characteristic of the invention, all of the motors M1, M2, M3, M4, . . . , are disposed on an arc of a circle around said block of driving gear wheels 16.

To minimize bulk, they are disposed in alternation and parallel to the axis 15 towards opposite axial ends of the block 16. For example, if there are seven printwheels 5 to be set, and thus seven motors M and seven driving gear wheels R, then four motors M are provided towards one end of the block 16 (the four motors M1 to M4 that are shown), while the other three motors M are towards the other end of the block 16.

At each end of the block 16, the various motors (e.g. M1 to M4) are disposed in a staggered configuration relative to the axis 15, so as to minimize bulk. For example, the motors M1 and M3 are placed close to the block 16 in said axial direction 15, with their shafts 13 carrying the gear wheels 15 thus being relatively short, whereas the motors M2 and M4 are placed behind the motors M1 and M2 still in said direction 15, with their shafts therefore being relatively long.

According to an essential characteristic of the invention, this entire set of motors M1, M2, M3, . . . , and the block 16 of driving gear wheels forms a portion of the control module 17 for setting the printwheels 5 that is mounted to pivot forwards and backwards along the axis 7 of the head 2 about a pivot axis 18.

The pivoted-back or retracted position is shown in FIG. 1. In this position, the block of driving gear wheels 16 is declared, and therefore does not engage the respective first driven gear wheels 19 which, as described below, constitute the first links in gear drive systems 20 capable of rotating respective ones of the printwheels 5 in order to set them.

Figure 2:
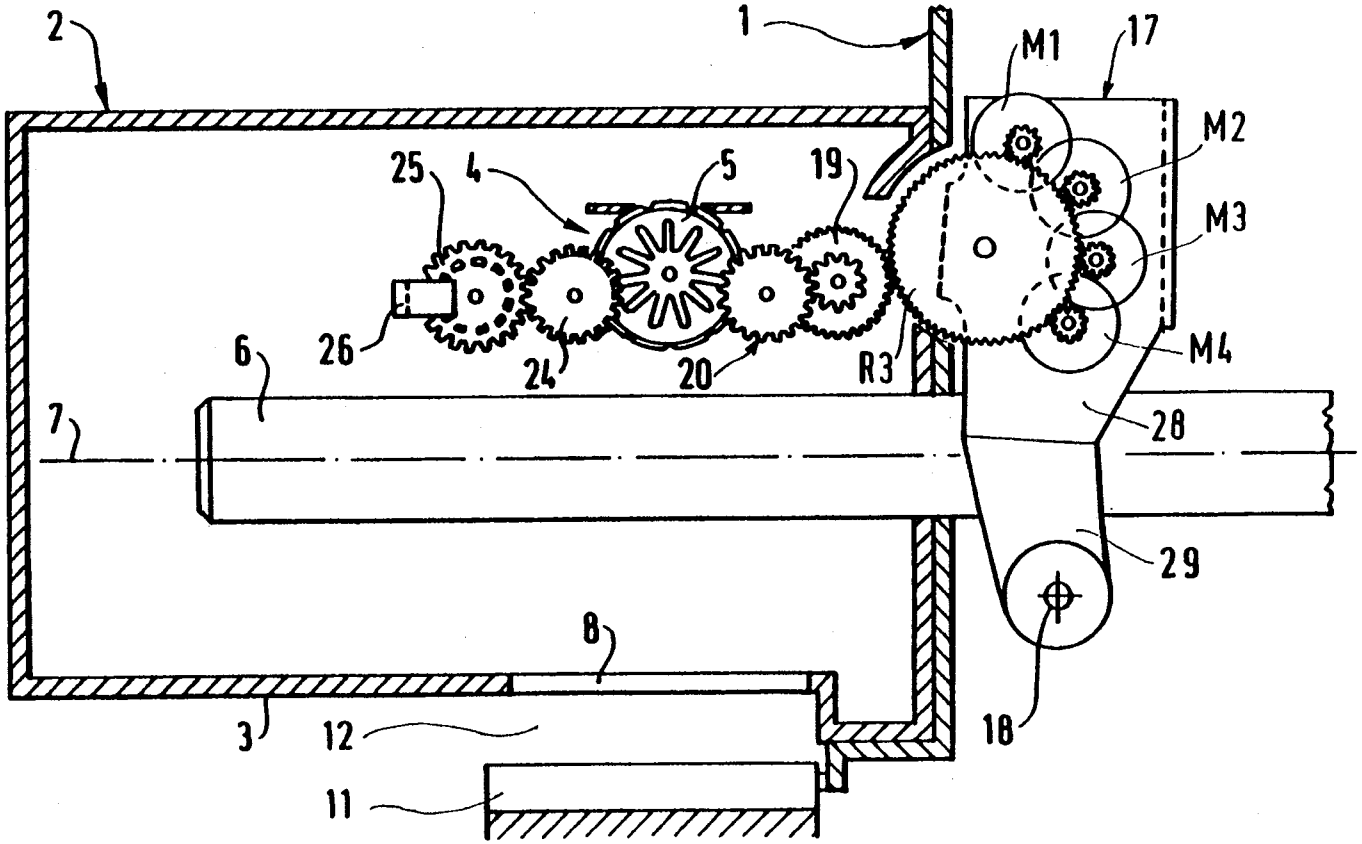
FIG. 2 is a view similar to FIG. 1, showing the same control module tilted to its furthest-forwards position, and thus in engagement with the train of driven gear wheels associated with each printwheel.
Figure 4:
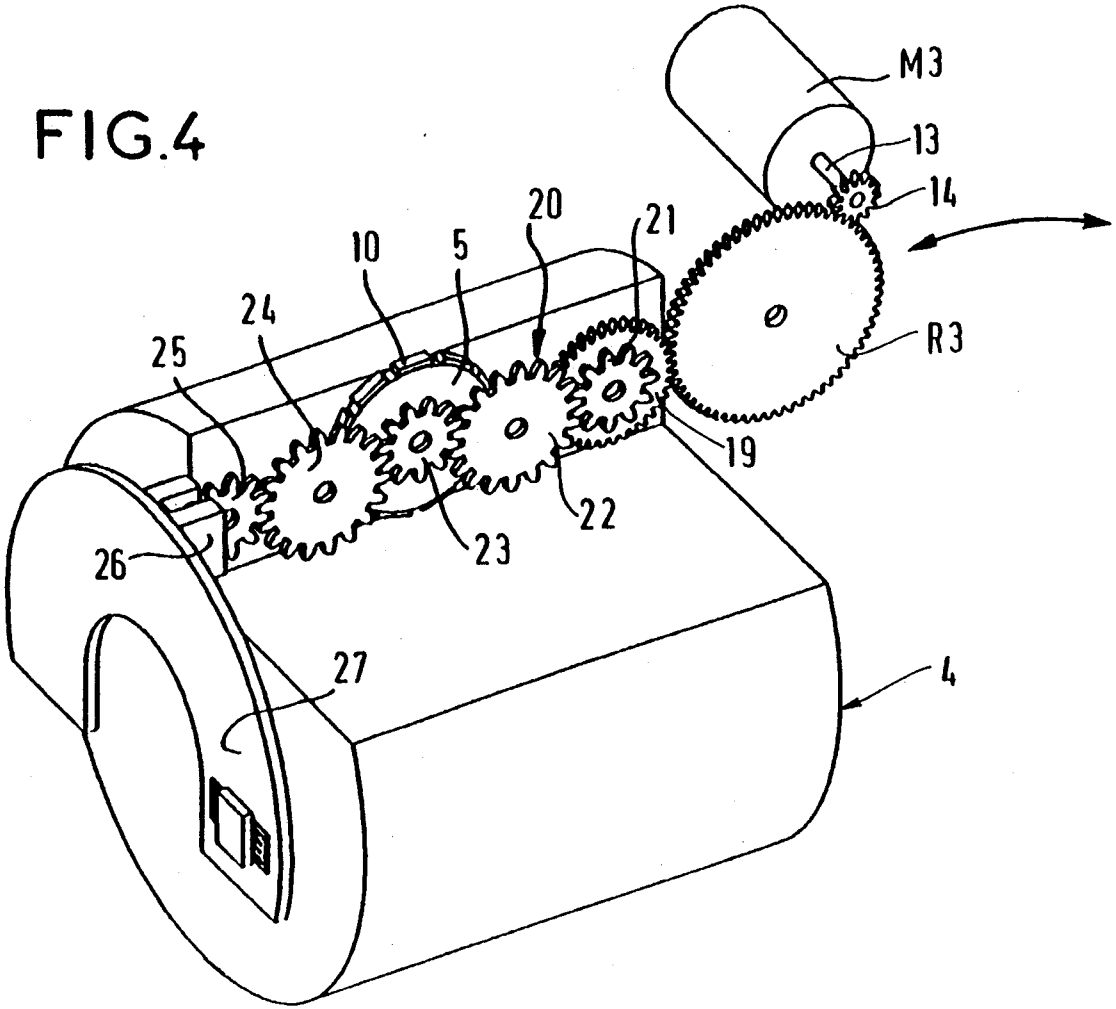
FIG. 4 is a very fragmentary perspective view of the print drum with one of its printwheels in the adjustment position as shown in FIG. 2.

The tilted-forwards or extended position is the position shown in FIGS. 2 and 4. All of the large driving gear wheels of the block 16, such as the gear wheel R3, are then engaged in the respective first driven gear wheels (such as corresponding gear wheel 19) in the respective gear drive systems 20 associated with the respective printwheels 5 and included inside the head 2.

Each drive system 20 comprises a system of intermeshing gear wheels.

As can be seen in particular in FIG. 4, the large driving gear wheel R3 that forms a portion of the base meshes with the first gear wheel 19 of the gear drive system 20 that forms a portion of the head.

The gear wheel 19 is secured to a coaxial gear wheel 21 which in turn, via an intermediate gear wheel 22, drives the gear wheel 23 that is secured to the printwheel 5 and that is coaxial therewith.

In addition, the gear wheel 23 acts via a gear wheel 24 to rotate a toothed encoding wheel 25. The position of the position-encoding wheel 25 is detected by an optoelectronic sensor 26 in the form of a fork that provides an output signal which is processed by an electronics card 25, secured in this example to the drum 4 and that serves to measure the digit or letter position 10 of the printwheel 5, which measured position is compared with that input by the above-mentioned control keypad for the purpose of taking appropriate action on the rotation of the motor M3.

Figure 5:
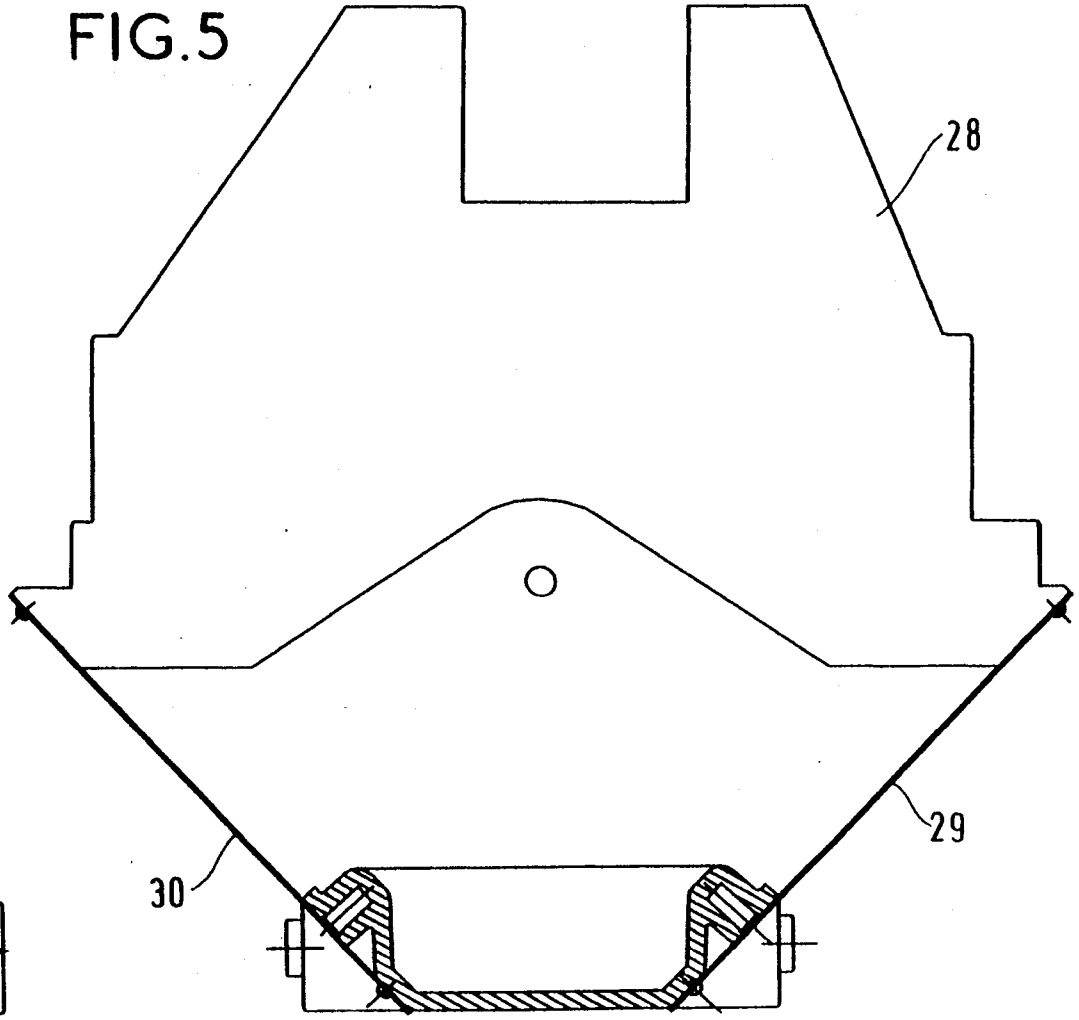
FIGS. 5 and 6 are respectively an end view and a side view of the support block for the control module, the motors and the sets of gearing being omitted for greater clarity.
Figure 6:
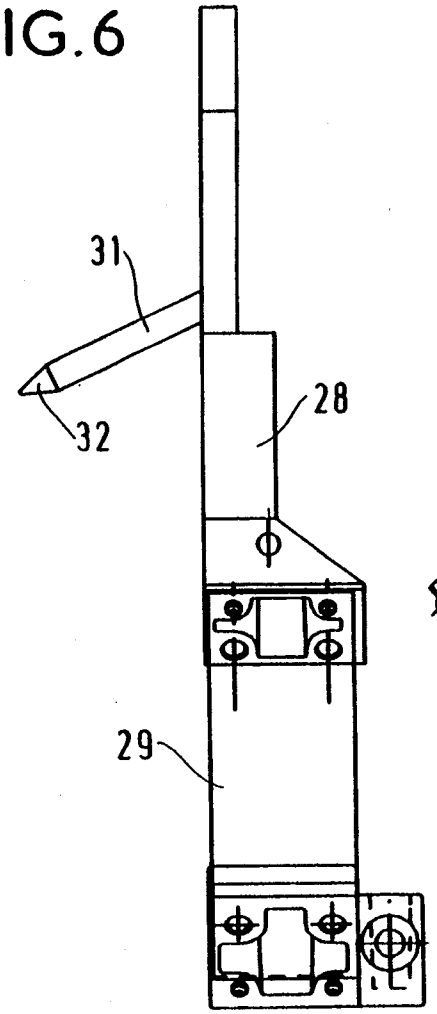

According to another characteristic of the invention, shown more specifically in FIGS. 5 and 6, the frame 28 for supporting the pivoting control module 17 is mounted on two resilient metal plates 29 and 30 that together form a V-shape interconnecting the frame 28 and the pivot axis 18 (FIGS. 1 to 2).

The control module 17 is thus mounted on a resilient support 29, 30, thereby guaranteeing positive meshing between the driving gear wheels R1, R2, R3, . . . , secured to the pivoting module 17 and the inlet gear wheels 19 of the drive systems 20 associated with the various printwheels 5 of the drum 4. In other words, it is certain that meshing will take place.

To guide the module 17 while facilitating meshing thereof with the driven gear wheels 19 of the drum 4, the frame 28 of said block 17 is further provided with a centering finger 31 (FIGS. 6 to 9) having a conical tip 32.

This centering finger 31 projects from the frame 28 towards the head 2, and when the control module 17 is pivoted forwards into the meshing position (as shown in FIGS. 2 to 8), the finger is received in a corresponding oblong orifice 33 (see FIG. 9) provided for this purpose in a tab 4A of the rotary print drum 4.

Figure 3:
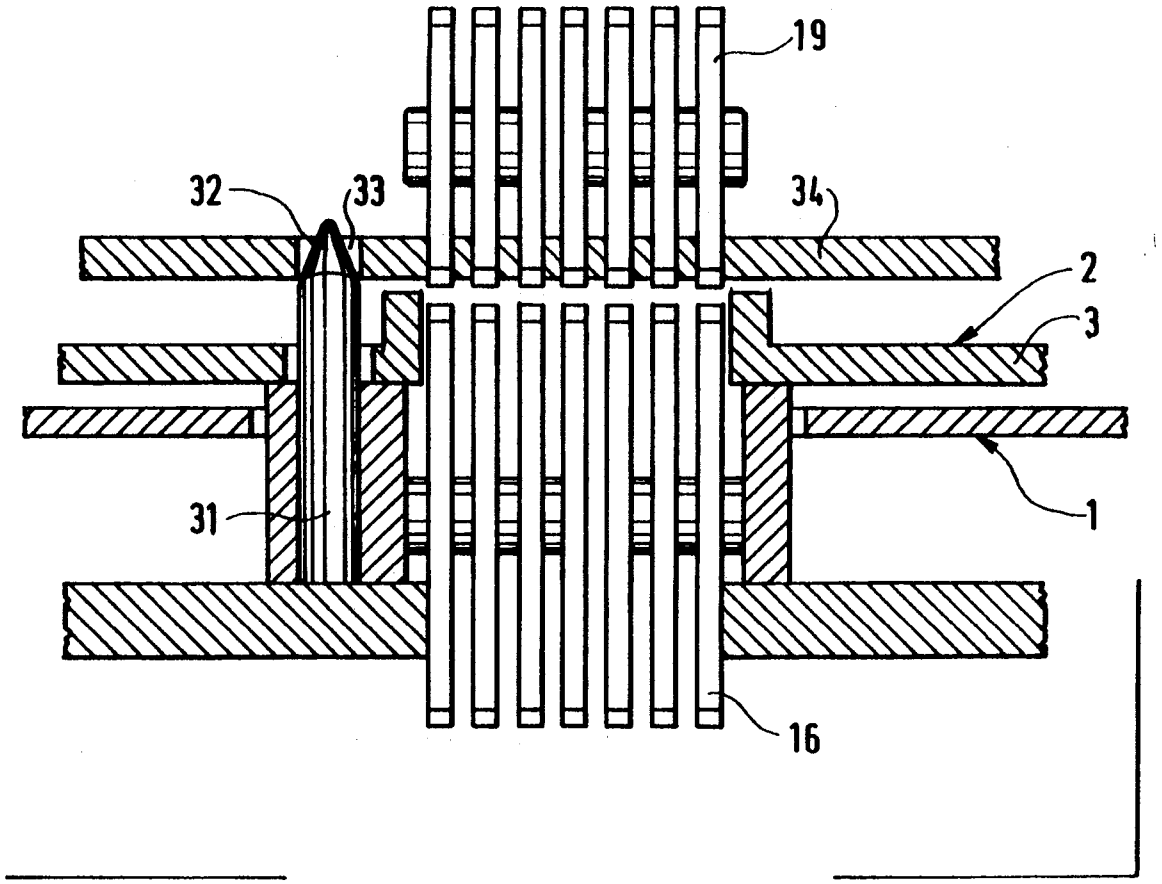
FIG. 3 is a fragmentary plan view corresponding to FIGS. 1 and 2 and showing how the driven and driving gear wheels co-operate.

The combination of this centering finger 31 and of the resilient support blades 29 and 30 makes it possible to ensure that the module 17 is always properly positioned when the driving gear wheels secured to said block mesh with the driven gear wheels secured to the drum 4 (of. FIG. 3).

In addition, this resilient mounting of the frame 28 of the module 17 makes it easy to use a progressive and accurate device for controlling pivoting of the module 17, e.g. of the screw and nut type, as now described with reference to FIGS. 7 and 8, in which such a device is shown.

Figure 7:
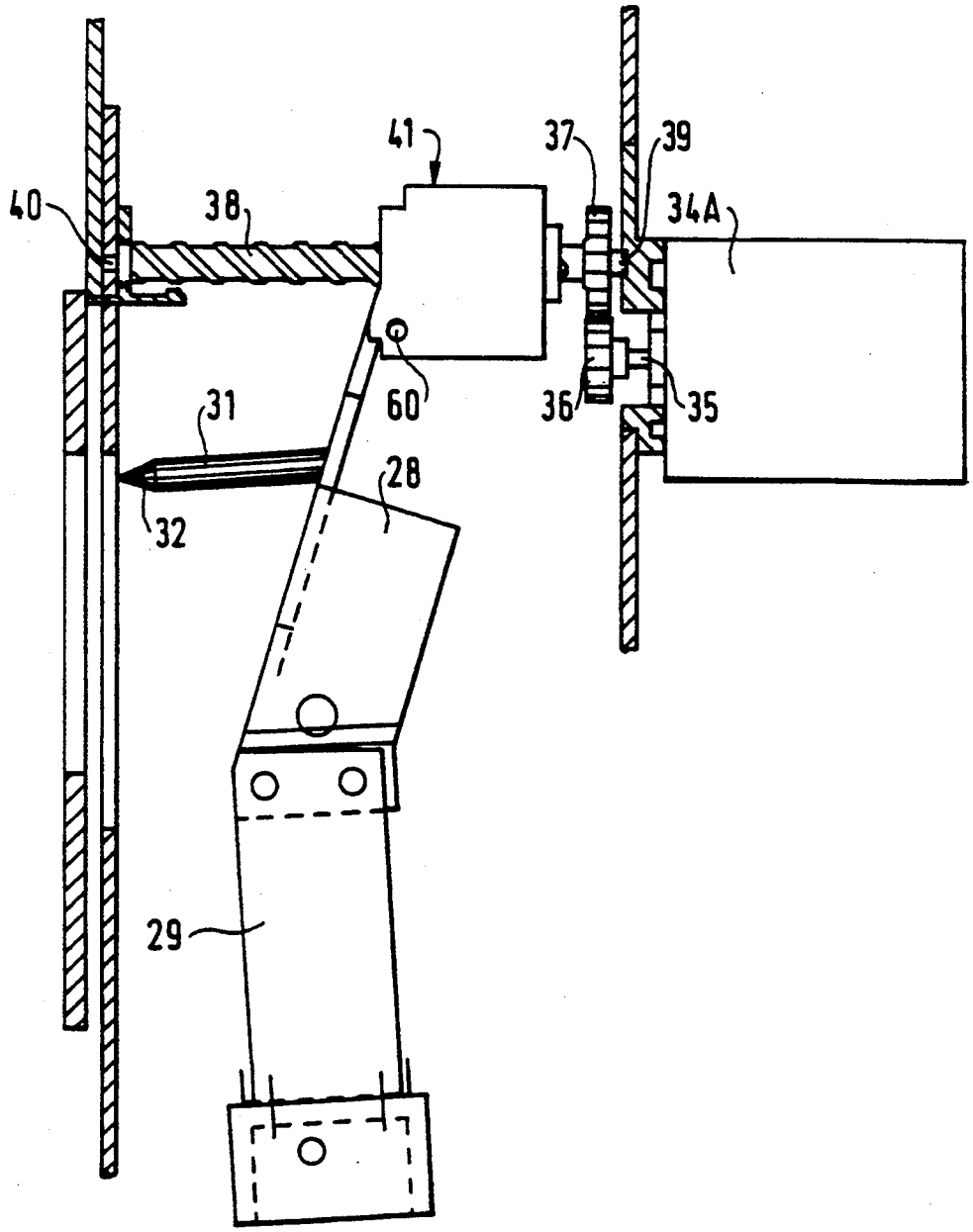
FIGS. 7 and 8 are side views with many elements omitted, as in FIG. 6, showing the support block and its tilting control mechanism respectively in the furthest-back position and in the furthest-forward position thereof.
Figure 8:
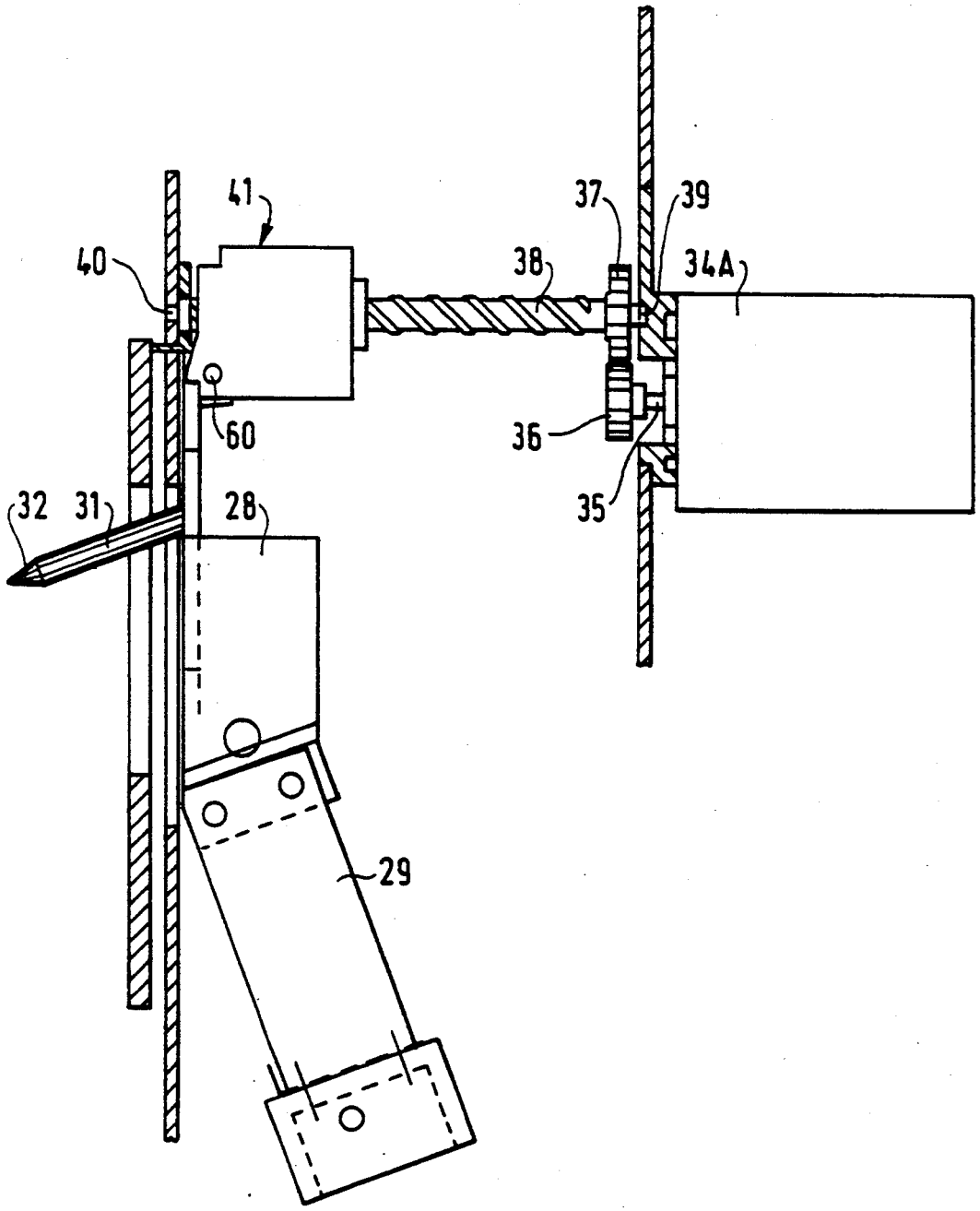

In FIGS. 7 and 8, which show the pivoting frame 21 respectively in its furthest-back position and in its furthest-forward position, an electric motor 34A is provided which is secured in the base and whose direction of rotation is controlled from the keypad of the base via the associated electronics card, such that the motor is caused to rotate in one direction or the other.

The shaft 35 of the motor 34A carries a gear wheel 36 which drives another gear wheel 37 secured to a worm screw 38 whose axis is parallel to the axis of the head 2 and which is mounted free to rotate between two end bearings 39 and 40.

The pivoting frame 28 is itself secured to a nut 41 that is prevented from rotating and that is engaged on the rotary screw 38. In conventional manner, rotation of the motor 34, and thus of the screw 38 causes the nut 41 to be moved along the screw 38 in one direction or the other.

This gives rise to progressive and controlled pivoting of the frame 28 forwards or backwards, with the resilient blades 29 and 30 absorbing any differences due to successive positions of the pivoting frame relative to the screw 38: the displacement of the nut is rectilinear, whereas the frame 28 pivots on a circular arc, about a pin 60 secured to the nut 41.

Finally, according to another feature of the invention that is optional, but advantageous, the centering finger 31 also serves, when advanced so as to penetrate into the orifice, as a finger for causing the printwheels 5 of the print drum 4 to be unlocked.

As explained, for example, in French patent application FR-A-2 665 781, filed on Aug. 7, 1990, it is known that the removable head of a postage meter is required to include a device for locking the printwheels so as to guarantee that the set position of the printwheels cannot be changed while the drum is rotating, e.g. by deliberate or accidental keying on the keypad.

Figure 9:
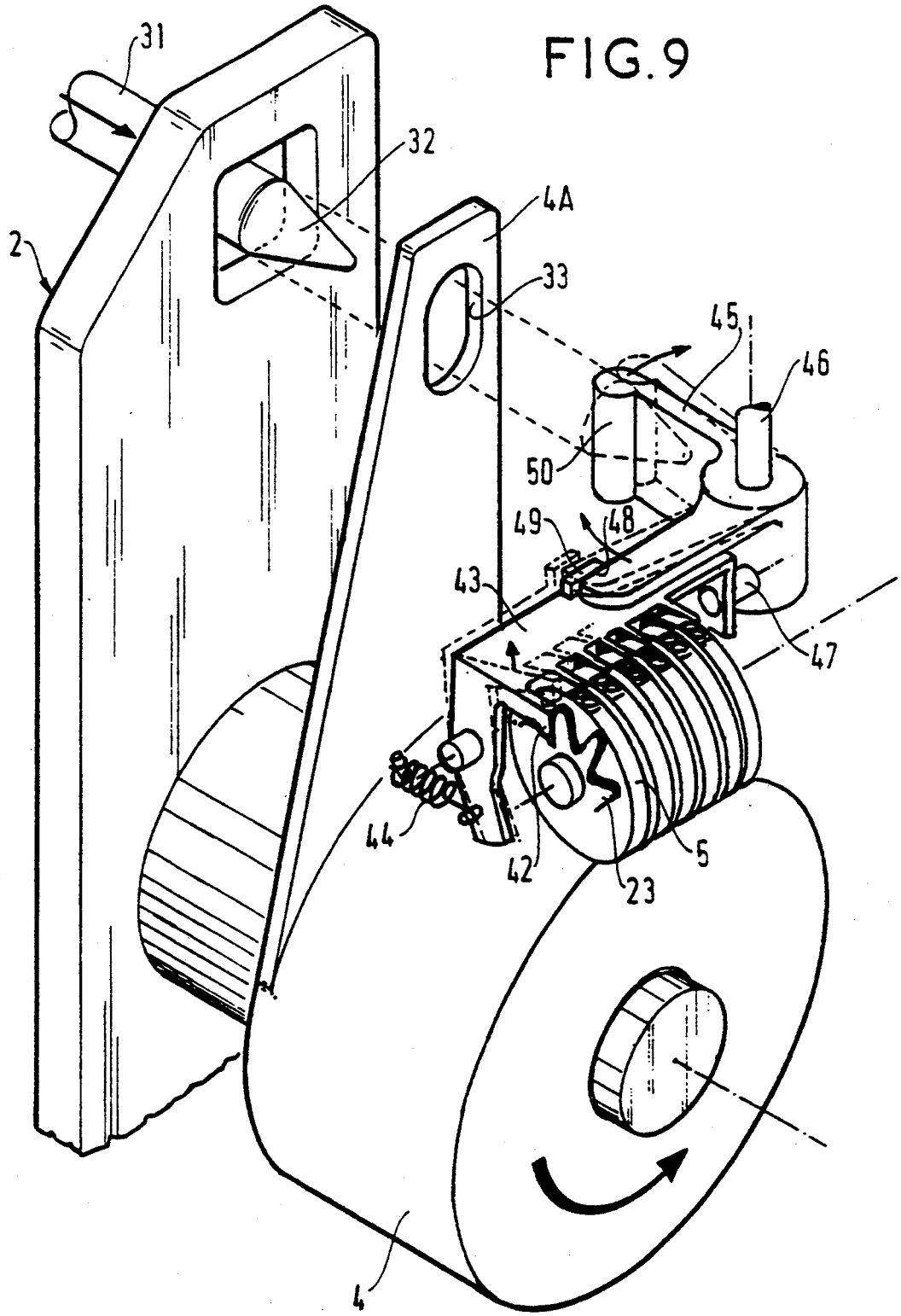
FIG. 9 is a fairly free diagrammatic perspective view showing the additional function of unlocking the printwheels that is performed by the centering finger of the control module.

Thus, as is required, the postage meter includes a locking device for the printwheels 5, which device does not, per se, form a portion of the present invention, and a simplified, but plausible embodiment thereof is shown in FIG. 9.

As shown in FIG. 9, the gear wheels 23 that are secured to respective ones of the various printwheels 5 are normally held in position by complementary teeth 42 of a tilting bail 43 which is secured to the print drum 4 and which is urged by powerful return spring means 44 into a position (shown in solid lines) for locking the printwheels 5.

The bail 43 is tilted into its position for unlocking the printwheels 5 (shown in dashed lines) under the control of a crank lever 45 mounted to rock about an axis 46 that is orthogonal to the tilt axis 47 of the bail 43, a first end 48 of the crank lever bearing against an abutment 49 secured to the bail 43 while the opposite end 50 thereof is free and is designed to be pushed back in the clockwise direction and as indicated by the arrow by the finger 31, 32 when said finger is advanced (as shown in dashed lines) so as to come into lateral engagement against said free end 50 of the lever 45. It can thus clearly be seen that said finger 31 serves not only as a member for centering the control block 17, but also as a member for controlling unlocking of the printwheels 5, which unlocking is required, in the present invention, to enable said printwheels to be set from the keypad in the base 1.

Naturally, the invention is not limited to the embodiments described above. On the contrary, the invention can be implemented in numerous equivalent forms.

What is claimed is:

1. A device for setting the position of printwheels (5) of a postage meter, said postage meter comprising: a base and a head which is removable from the base (1), and which includes a print drum (4) fitted with printwheels (5), and a rotary gear drive train (20) including a driven gear wheel for each printwheel; and a setting control module (17), for setting the position of each of the printwheels (5), provided in the base (1) and including a plurality of externally controlled motors (M1, M2, M3, M4, . . .) and a plurality of driving gear wheels, there being one motor per printwheel (5) whose position is to be set, each motor driving at least one respective driving gear wheel provided in said base and suitable for direct meshing with the gear drive train (20) that is provided in said head (2), and acting directly on the driven gear wheel secured to each printwheel (5) for setting the position thereof; wherein:

said gear drive train (20) is a rotary gear system (19, 21, 22) constituting a rotary gear train without any sliding rod having a toothed rack;

the driving gear wheels are coaxial and parallel, together forming a block (16) of substantially cylindrical outline; and said motors (M1, M2, M3, M4, . . .) are disposed on a circular arc around said block (16) so as to co-operate therewith to form said setting control module (17);

said device comprises means for mounting said control module (17) to pivot about a pivot axis (18) between a rear, retracted position, in which the driving gear wheels are disengaged and remote from the respective gear trains (20) included in the head (2), and a front, extended position in which said driving gear wheels are in respective positions where they directly mesh with said driving gear trains (20); and said device further comprises means for mounting said control module (17) on one or more resilient supports (29, 30) connecting said control module to its said pivot axis (18).

2. A setting device according to claim 1, characterized in that the control module (17) is fitted with at least one centering finger (31) which projects relative to said driving gear wheels towards the head (2), said centering finger (31), when the module (17) is pivoted to its meshing front position, engaging a corresponding oblong orifice (33) of a tab (4A) of the drum (4).

3. A setting device according to claim 2, characterized in that said centering finger (31), when the module (17) is in its meshing front position and when said finger is thus engaged in said orifice (33), acts on a device (45, (43) for unlocking the printwheels (5).

4. A setting device according to claim 1, characterized in that said motors (M1, M2, M3, M4, . . .) are disposed towards both ends of said substantially cylindrical block (16), and are staggered relative to one another towards each end of said block (16).

5. A setting device according to claim 1, characterized in that said resilient supports for the control module (17) are constituted by two resilient blades (29, 30) disposed in a V-shape.

6. A setting device according to claim 1, further comprising a screw and nut (38, 41) drive system (34 to 41) for pivoting said control module in a controlled manner.

* * * * *